United States Patent [19]

Iwai et al.

[11] Patent Number: 4,673,358

[45] Date of Patent: Jun. 16, 1987

[54] MOUNTING ARRANGEMENT FOR OUTBOARD DRIVE

[75] Inventors: Tomio Iwai, Hamamatsu; Ryoji Nakahama, Iwata, both of Japan

[73] Assignee: Sanshin Kogyo Kabushiki Kaisha, Hamamatsu, Japan

[21] Appl. No.: 734,453

[22] Filed: May 15, 1985

[30] Foreign Application Priority Data

May 22, 1984 [JP] Japan ..... 59-101647

[51] Int. Cl.[4] ..... B63H 21/26

[52] U.S. Cl. ..... 440/61; 440/53; 440/63; 440/56; 248/640; 248/642

[58] Field of Search ..... 440/53, 55, 56, 61, 440/63, 65, 900; 248/640, 642, 641, 643

[56] References Cited

U.S. PATENT DOCUMENTS

| | | | |
|---|---|---|---|
| 3,269,351 | 8/1966 | Shimanckas . | |
| 3,570,443 | 3/1971 | Dewhurst . | |
| 4,013,249 | 3/1977 | Meyer . | |
| 4,096,820 | 6/1978 | Hall | 440/56 |
| 4,154,417 | 5/1979 | Foley, Jr. | 440/63 X |
| 4,354,848 | 10/1982 | Hall et al. | 440/61 |
| 4,355,986 | 10/1982 | Stevens . | |
| 4,363,629 | 12/1982 | Hall et al. | 440/61 |
| 4,449,945 | 5/1984 | Ferguson | 440/53 |
| 4,482,332 | 11/1984 | Emmons | 248/642 X |

FOREIGN PATENT DOCUMENTS

| | | |
|---|---|---|
| 42-3942 | 3/1967 | Japan . |

*Primary Examiner*—Joseph F. Peters, Jr.
*Assistant Examiner*—Paul E. Salmon
*Attorney, Agent, or Firm*—Ernest A. Beutler

[57] ABSTRACT

An improved supporting arrangement for an outboard motor or marine outboard drive wherein a pair of links are pivotally connected at one of their ends to the transom of the associated watercraft and at the other of their ends to the outboard drive for movement of the outboard drive between a trimmed down position and a tilted up out of the water position. One of the links is expandible in length and a fluid motor is provided for this purpose. In addition, a further fluid motor is pivotally connected between one of the links and the transom for effecting the pivotal movement. Various alternative linkage arrangements are illustrated.

46 Claims, 16 Drawing Figures

MOUNTING ARRANGEMENT FOR OUTBOARD DRIVE

BACKGROUND OF THE INVENTION

This invention relates to a mounting arrangement for an outboard drive and more particularly to an improved mounting arrangement for mounting an outboard drive for movement between a tilted down position through a plurality of trim adjusted positions to a tilted up out of the water position.

It is well known to mount marine outboard drives such as the outboard drive portion of an inboard-outboard drive or an outboard motor per se for movement relative to the transom of the associated watercraft between a plurality of trim adjusted positions so that the propeller will assume the appropriate driving position relative to the body of water in which it is operating and at the appropriate angle relative to the transom of the associated watercraft. It is further proposed to mount such outboard drive units for movement so that the propeller can be tilted up completely out of the water. The more conventional type of tilting arrangement mounts the outboard drive for pivotal movement about a single, horizontally disposed axis. Although such arrangements have the advantages of simplicity, when used in conjunction with outboard motors they tend to have the power head of the outboard motor encroach into the watercraft when the motor is tilted up. In addition, such single pivot axis supports do not always permit the propeller to be disposed at the optimum driving angle. It has, therefore, been proposed to provide a double linkage system for supporting the outboard drive for its movement and such an arrangement is shown in the copending application entitled "Tilting Device For Outboard Engine", Ser. No. 672,410, filed Nov. 16, 1984 in the name of Ryoji Nakahama et al and assigned to the assignee of this application. This invention relates to an improvement in the type of support shown generally in that application.

Although the use of such a twin linkage system in which the links are disposed in a non-parallel relationship permits attainment of the objects as disclosed in that application, it is believed that still further improvements in the mechanism and its operating system are possible.

It is, therefore, a principal object of this invention to provide a mounting arrangement for an outboard drive that insures the proper positioning of the drive under all running conditions.

It is a further object of this invention to provide an improved linkage system for suspending outboard drives.

It is another object of this invention to provide a linkage system for suspending a marine outboard drive that will permit good position adjustment, maximum tilting up of the outboard drive and a minimum encroachment of the outboard drive within the area of the associated watercraft.

SUMMARY OF THE INVENTION

This invention is adapted to be embodied in a supporting arrangement for suspending a marine outboard drive from the transom of an associated watercraft for movement between a tilted down running position to a tilted up out of the water position. The supporting arrangement comprises a first link that is adapted to be pivotally connected at one of its ends to the associated transom at a first pivot axis and at its other end to the outboard drive at a second pivot axis. A second link is provided that is adapted to be pivotally connected at one of its ends to the associated transom at a third pivot axis and at its other end to the outboard drive at a fourth pivot axis. Means are provided for changing the effective length of the second link to accommodate movement of the outboard drive relative to the transom of the associated watercraft from its tilted down position toward its tilted up position.

DETAILED DESCRIPTION OF THE PREFERRED EMBODIMENTS

Figure 1:
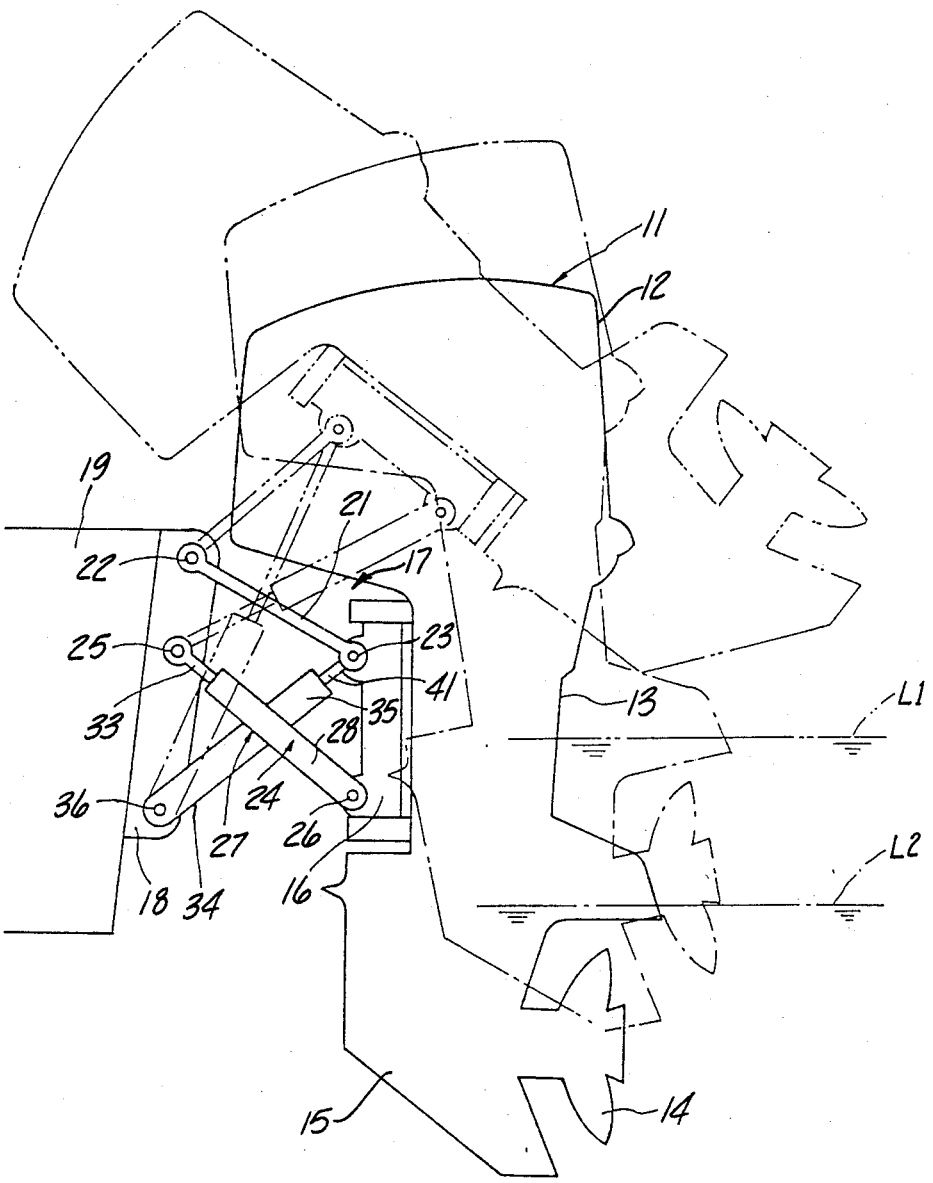
FIG. 1 is a side elevational view of an outboard motor suspended from an associated watercraft in a manner in accordance with an embodiment of the invention. The solid line view shows the outboard motor in its fully tilted down position, the dot-dash line view shows the outboard motor in a trimmed up condition and the dot-dot-dash line view shows the outboard motor in its fully tilted up condition.

In FIG. 1, an outboard motor suspended in accordance with an embodiment of the invention is identified generally by the reference numeral 11. Although the invention is particularly adapted for use with outboard motors, it is to be understood that it is capable of being utilized with the outboard drive unit of an inboard-outboard drive arrangement. For this reason, the term "outboard drive" as used in the specification and claims is intended to encompass outboard motors or the outboard drive unit of such an inboard-outboard arrangement. The outboard motor 11 includes a power head 12 consisting of a protective cowling and internal combustion engine. The engine of the power head 12 drives a drive shaft that extends through a drive shaft housing 13 and which drives a propeller 14 supported by a lower unit 15 in a suitable manner, as though a conventional forward, neutral, reverse transmission. Inasmuch as the details of the construction of the outboard motor 11 per se form no part of the invention, the internal details of the outboard motor 11 have not been illustrated and will not be described.

A steering shaft (not shown) is affixed to the drive shaft housing 13 and is journaled within a swivel bracket assembly 16 for steering movement of the outboard motor 11 about a vertically extending steering axis. A linkage construction, indicated generally by the reference numeral 17 is provided for supporting the outboard motor 11 for movement relative to a transom bracket 18 that is affixed to a hull of an associated watercraft 19. The linkage assembly 17 permits movement of the outboard motor 11 from a fully trimmed down condition, as shown in the solid line view of FIG. 1, through any of a plurality of trim adjusted positions to a miximum trim up adjusted position, as shown in the dot-dash line view, and to a tilted up out of the water condition, as shown in the dot-dot-dash line view.

The linkage assemby 17 includes a first upper link 21 that is pivotally connected at its forward end to the transom bracket 18 by means of a pivot pin 22 for pivotal movement about a first pivot axis. The rear or trailing end of the link 21 is pivotally connected to the swivel bracket 16 by means of a pivot pin 23 for pivotal movement about a second pivot axis. In this embodiment, the link 21 is rigid and inextensible.

A second, lower link, indicated generally by the reference numeral 24 is pivotally connected at its forward end to the transom bracket 18 by means of a pivot pin 25 for pivotal movement about a third pivot axis that is offset and spaced from the first and second pivot axes defined by the pivot pins 22 and 23, respectively. The rear end of the second link 24 is pivotally connected to the swivel bracket 16 by means of a pivot pin 26 that defines a fourth pivot axis that is offset from the first, second and third pivot axes.

In accordance with this embodiment of the invention, the line 24 is an extensible link and is comprised of a fluid motor, indicated generally by the reference numeral 27. The fluid motor 27 includes a cylinder housing assembly 28 that has a trunnion at its rear end which accommodates the pivot pin 26. As seen in schematic view FIG. 2, a piston 29 is slidably supported within the bore of the cylinder housing assembly 28 and divides it into upper fluid chamber 31 and a lower fluid chamber 32. The piston 29 is affixed to a piston rod 33 that extends through the outer end of the cylinder assembly 27 and has an eye at its forward end that accommodates the pivot pin 25.

In this embodiment, the fluid motor 27 functions so as to move the outboard motor 11 from its fully trimmed up condition as shown in the dot-dash line to its tilted up out of the water condition as shown in the dot-dot-dash line view, as will become apparent.

Figure 2:
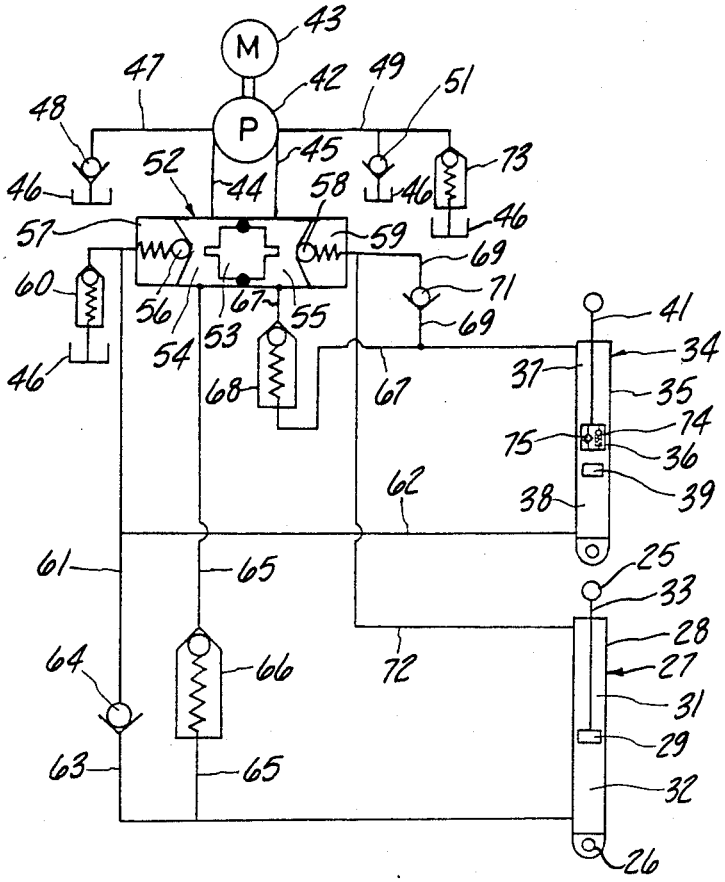
FIG. 2 is a partially schematic hydraulic circuit diagram for the hydraulic system of the mounting arrangement.

A further fluid motor, indicated generally by the reference numeral 34 is provided for adjusting the trim position of the outboard motor 11 and also for assisting in the tilting up operation. The fluid motor 34 includes a cylinder assembly 35 that has a trunnion at its lower end which affords a pivotal connection by means of a pivot pin 36 to the transom bracket 18 at a point below the pivot pins 22 and 25. As seen in FIG. 2, a piston 36 is sidably supported within the bore of the cylinder assembly 35 and divides it into an upper chamber 37 and a lower chamber 38. A floating piston 39 is positioned beneath the piston 36 and divides the lower chamber 38 into upper and lower portions. A piston rod 41 is affixed to the piston 36 and extends outwardly beyond the cylinder assembly 35. The upper end of the piston rod 41 is formed with an eyelet that is pivotally connected by means of the pivot pin 23 to the swivel bracket 16.

As has been noted, the solid line view in FIG. 1 shows the motor 11 in its fully tilted trimmed down position. This is the position when the associated watercraft 19 is not being driven or is traveling only at extremely low speeds and the water level is at the point L1 relative to the propeller 14. This is the desired condition during start up so that the propeller 14 will be fully submerged and at the appropriate angle relative to the hull of the watercraft 19 so as to afford good acceleration. As the watercraft 19 accelerates, however, it is desirable to operate the propeller 14 so that it will be only partially submerged as shown in the dot-dash line wherein the propeller 14 appears only partially submerged below the water level L2. To move the outboard motor 11 from the solid line to the dot-dash line positions, the fluid motor 34 is actuated, in the manner to be described, so as to effect pivotal movement of the links 21 and 24 so as to change the orientation of the motor 11. During this change in orientation, the angle of the propeller shaft changes relatively slightly relative to the hull of the watercraft 19. If it is desired to tilt the motor 11 up so that the propeller 14 is out of the water, when the motor and watecraft are stationary, both the cylinders 27 and 34 are activated in the manner now to be described.

Referring now to FIG. 2, the hydraulic system for operating the two cylinders or hydraulic motors 27 and 34 is illustrated schematically and will be described. A reversible fluid pump 42 is driven by a reversible electric motor 43 that is suitably positioned within the hull of the watercraft 19 and is controlled by the operator in a known manner. The pump 42 has a first port to which a line 44 extends and a second port to which a line 45 extends. The port served by the line 44 is also connected to a reservoir 46 by means of a line 47 and check valve 48. In a similar manner, the port served by the line 45 is adapted to communicate with the reservoir 46 through a line 49 in which a check valve 51 is provided.

A shuttle valve assembly, indicated generally by the reference numeral 52 is provided with a floating piston 53 that defines first and second chambers 54 and 55 that communicate with the lines 44 and 45, respectively. A check valve 56 communicates the chamber 54 with a further chamber 57. In a like manner, a check valve 58 communicates the chamber 55 with a still further chamber 59.

The chamber 57 communicates with a line 61 that is intersected by a line 62 that extends to the chamber 38 of the fluid motor 34 below its floating piston 39. The line 61 also communicates with the chamber 32 of the fluid motor 27 below its piston 29 through a line 63 and check valve 64. The check valve 64 is disposed so as to permit flow from the line 63 to the line 61 but precludes flow in the opposite direction.

A line 65 extends from the shuttle valve chamber 54 to the line 63 and the fluid motor chamber 32. A pressure responsive valve 66 is provided in this line that permits flow from the shuttle valve chamber 54 to the fluid motor chamber 32 when a predetermined pressure is experienced. The pressure necessary to open the valve 66 is greater than the pressure necessary to open the check valve 56.

A tilt up relief valve 60 is provided in the line 61 and is adapted to communicate fluid pressure back to the reservoir 46 under conditions as will be described.

A line 67 extends from the shuttle valve chamber 55 to the fluid motor chamber 37 of the fluid motor 34. A pressure responsive valve 68 is provided in the line 67 and requires a greater pressure to open it than does the check valve 58. A line 69 extends from the shuttle valve chamber 59 to the line 67 between the check valve 68 and the fluid motor chamber 37. A one-way check valve 71 is provided in the line 69 so as to prevent flow from the chamber 59 into the line 67 while permitting flow in the opposite direction. The line 69 is also intersected by a line 72 upstream of the check valve 71, which line extends to the chamber 31 of the fluid motor 27.

A tilt down pressure relief valve 73 is provided in the line 49 and communicates the line 49 with the reservoir 46 for tilt down relief, as will become apparent.

A pressure responsive absorber valve 74 is provided in the piston 36 for permitting flow from the chamber 37 to the portion of the chamber 38 above the floating piston 39 if the outboard motor 11 strikes an underwater obstacle with sufficient impact. A relief valve 75 formed in the piston 36 permits flow in the opposite direction. The relief valve 75 opens at a substantially lower pressure than the absorber valve 74 and is responsive primarily to the weight of the outboard motor 11 so as to permit it to return to the normal trim adjusted position once the underwater obstacle is cleared.

The operation of this embodiment will now be described primarily by reference to FIGS. 1 and 2. FIG. 1, as has already been noted, shows the general construction and the various orientations of the outboard motor 11 that are possible with the linkage system 17. If the outboard motor 11 is operating in any of its normal trim adjusted positions and an underwater obstacle is struck with sufficient force as to overcome the action of the absorber valve 74, the motor 11 can pop up through pivotal movement of the links 21 and 24 and fluid will flow through the absorber valve 74 from the chamber 37 to the portion of the chamber 38 above the floating piston 39. There will be some slight movement of the floating piston 39 due to the difference in volumes displaced by the piston rod 41, however, this small movement is relatively insignifcant. Once the underwater obstacle is cleared, the relief valve 75 will open so as to permit flow back from the portion of the chamber 38 above the piston 39 to the chamber 37 and the motor 11 will return to its trim adjusted position If it is desired to achieve power trim up adjustment, the motor 43 is operated so as to drive the pump 42 so that the line 44 is pressurized and the line 45 acts as a return line. Under this condition, the shuttle valve chamber 54 will become pressurized and the shuttle piston 53 will shift to the right as viewed in FIG. 2. The shuttle piston 52 has a projection that will engage the ball of the check valve 58 and unseat it so as to open communication between the shuttle chambers 55 and 59. The pressurization within the chamber 54 is also sufficient so as to overcome the action of the check valve 56 and it will be opened to communicate the chambers 54 and 57 with each other.

When the check valve 56 is opened, the line 61 will be pressurized and this pressure will be transmitted through the line 62 to the fluid motor chamber 38 below the floating pistion 39 so as to urge the floating piston 39 and piston 36 outwardly. This force is applied through the pivot pin 23 so as to pivot the linkage 17 and effect trim up of the motor 11.

During the time of this operation, there will not be sufficient pressure generated so as to unseat the pressure responsive valve 66 and the fluid motor 27 will not be pressurized so that it will act as a solid link.

Fluid that is displaced from the chamber 37 of the fluid motor 34 will flow through the line 67 past the check valve 71 into the shuttle valve chamber 59. Since the check valve 58 is held open, this fluid may enter the chamber 55 and flow into the line 45 which acts as a return line. If makeup fluid is required, it can be drawn from the reservoir 46 through the check valve 51 and line 49.

At any time the motor 49 and pump 42 are stopped, the floating piston 39 will hold the piston 36 in position and set the trim adjusted position of the outboard motor 11. It may, however, pop up in the manner as aforedescribed.

If it desired to tilt the outboard motor 11 up so that the propeller 14 is clear of the water, the motor 43 and pump 42 are continuously energized until the piston 36 reaches the end of its stroke. At this time, there will be a sufficient pressure rise in the line 65 so as to open the check valve 66 and pressurize the line 63 and the chamber 32 below the piston 39 of the fluid motor 24. The piston 29 will then expand driving the piston rod 33 outwardly and effecting pivotal movement of the outboard motor 11 about the link 21. That is, during this condition, the link 21 will be held in its fixed position and the outboard motor 11 will pivot about the pivot pin 23 to the fully tilted up position as shown in FIG. 1. When the motor 11 if fully tilted up, the pressure in the line 61 will rise sufficiently to open the relief valve 60 and direct further fluid back to the reservoir 46 to prevent damage.

When it is desired to tilt the motor down, the pump 42 is driven in the reverse direction by reversely energizing the motor 43 so that the line 45 acts as the pressure line and the line 44 acts as the return line. When this occurs, the shuttle piston 53 will be forced to the left and a further projection will unseat the ball check valve 56 so as to open the communication between the shuttle valve chambers 54 and 57.

Pressurization of the chamber 55 further causes the check valve 58 to open so as to open the communication between the chambers 55 and 59 and fluid may flow through the line 72 to the chamber 31 above the piston 29. Since the check valve 68 opens at a higher pressure than the check valve 58, it will be held closed during this condition until the piston 29 moves through the end of its stroke. Fluid is displaced from the chamber 32 through the line 63 and open check valve 64 back to the line 61. Since the check valve 56 is held open, as aforenoted, the fluid may return through the line 44. If makeup fluid is required, it can be drawn from the line 49 and check valve 48 from the sump 46. During this initial tilting down movement of the motor 11, the piston 36 will be held at the end of its stroke and the pivotal movement will occur about the pivot pin 23.

When the piston 29 has completed its stroke and the chamber 32 is at its minimum volume and the chamber 31 is at its maximum volume, the motor 11 will be in the dot-dash line position shown in FIG. 1. At this time, the pressure in the chamber 55 of the shuttle valve 52 will rise sufficiently so as to open the check valve 68 and pressure will now be supplied to the chamber 37 of the fluid motor 34. When this occurs, the piston 36 and floating piston 39 will be urged downwardly and fluid will be expelled from the chamber 38 through the line 62 and shuttle valve chambers 57 and 54 back to the line 54 due to the fact that the check valve 56 is being held open by the projection of the piston 53.

When this action occurs, the links 21 and 24 will pivot in unison and the motor 11 will continue its downward movement so long as the operator energizes the motor 43. The desired trim position may then be set. When the motors 34 and 27 both reach the ends of their stroke, a pressure rise will occur in the line 45 and if the motor 43 is still energized, the relief valve 73 will open to prevent damage to the system.

In this embodiment, the fluid motor 34 operated to achieve the trim adjustment and also incorporated the pop up shock absorbing valve 74 and relief valve 75. It is to be understood, however, that the functions of the fluid motors 34 and 27 may be reversed and the floating piston may be incorporated in the line 24. If this is done, it is of course necessary to appropriately alter the location of the respective relief valves 66 and 68 so as to achieve the operation of the two motors in the desired sequence.

In addition to reversing the functioning of the fluid motors 27 and 34 and their specific relationships in the linkage system 17 as shown in FIGS. 1 and 2, various other arrangements may be provided wherein the linkage system and the location of the fluid motors in it can be altered, without departing the invention. Such various arrangements are shown in FIGS. 3 through 16. In view of the fact that the respective links 21 and 24 are the same in general orientation in these embodiments, and the fluid motors 27 and 34 are of the same construction as in the embodiment of FIGS. 1 and 2, these components are identified by the same reference numerals as are their respective pivot pins. Also, because of this similarity, the linkage system and interrelationship of the elements in the embodiments of FIGS. 13 through 16 is shown only schematically. Also, it is to be understood that the construction and function fo the fluid motors 34 and 27 may be reversed as was described in conjunction with the embodiment of FIGS. 1 and 2. That is, the fluid motor 27 may incorporate the floating piston and shock absorbing arrangement rather than the fluid motor 34. Of course, if this change is made, the appropriate change in the location of the pressure responsive check valves 66 and 68 must also be changed, as aforedescribed.

Figure 3:
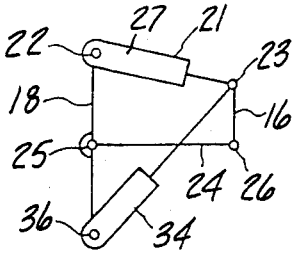

Referring now to these additional figures, FIG. 3 shows an embodiment wherein the fluid motor 27 rather than being positioned in the link 24 is positioned in the link 21 so that the link 21 is expansible rather than the link 24. Also, the fluid motor 27 is reversed so that its cylinder assembly will be connected to the pivot point 22 and its piston rod will be connected to the pivot point 23. Thus, the fluid connections to the ends of the chambers 28 and 32 must be reversed with this embodiment.

Figure 4:
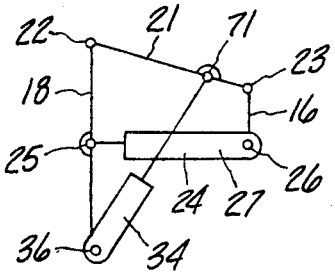
FIGS. 3 through 16 are schematic views showing other linkage arrangements that may be utilized in conjunction with the invention.

FIG. 4 shows an embodiment similar to FIGS. 1 and 2, however, the fluid motor 34 rather than having its piston rod connected to the pivot point 23 of the link 21 is connected to an intermediate point of the link 21 by means of a pivot point 71.

Figure 5:
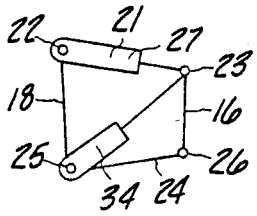

FIG. 5 shows an embodiment that is similar to the embodiment of FIG. 3 in that the fluid motor 27 is provided in the link 21 rather than in the link 24. In this embodiment, the fluid motor 34 has its cylinder assembly pivotally connected to the pivot pin 25 rather than to a separate pivot pin.

Figure 6:
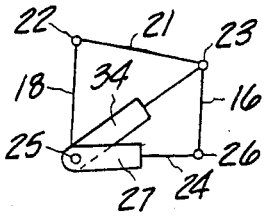

FIG. 6 shows an embodiment that is similar to the embodiment of FIGS. 1 and 2 with respect to the placement of the fluid motor 27 in the link 24. Like the embodiment of FIG. 5, however, the fluid motor 34 has its cylinder assembly connected to the pivot pin 25 rather than to a separate pivot pin. In addition, the fluid motor 27 is reversed so that its cylinder assembly is connected to the pivot pin 25 rather than to the pivot pin 26.

Figure 7:
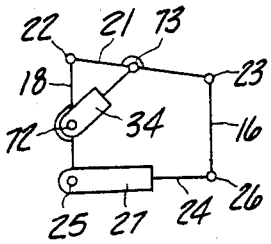

FIG. 7 shows an embodiment that is similar to the embodiment of FIG. 6, however, the pivotal connection of the fluid motor 34 to the transom bracket 18 and link 21 are in different locations. In this embodiment, the cylinder assembly of the fluid motor 34 is connected to the transom bracket 18 at a pivot point 72 that is disposed between the pivot points 21 and 25. The piston rod of the fluid motor 34 is connected to the link 21 between its ends at a pivot point 73.

Figure 8:
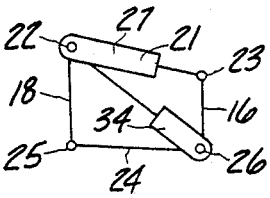

FIG. 8 shows an arrangement similar to FIG. 5, however, the fluid motor 34 is located differently. In this embodiment, the cylinder assembly of the fluid motor 34 is pivotally connected to the pivot point 26 and its piston rod is pivotally connected to the pivot point 22.

Figure 9:
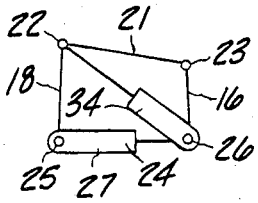

The embodiment of FIG. 9 is similar to the embodiment of FIG. 1 except that the fluid motor 27 is reversed in the link 24 so that its cylinder assembly is pivotally connected to the pivot pin 25 and its piston rod is connected to the pivot pin 26. In addition, the fluid motor 34 has its cylinder assembly pivotally connected to the pivot point 26 and its piston rod pivotally connected to the pivot point 22 like the embodiment of FIG. 8.

Figure 10:
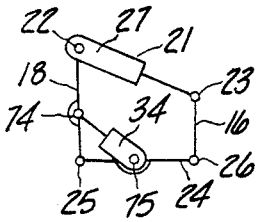

In the embodiment of FIG. 10, the fluid motor 27 is disposed in the link 21 in the same relationship as in the embodiments of FIGS. 3, 5, and 8. However, in this embodiment, the fluid motor 34 has its cylinder housing assembly pivotally connected to the link 24 intermediate the pivot points 25 and 26 at a pivot point 75. The piston rod of this fluid motor is connected to the transom bracket 18 at the pivot point 74.

Figure 11:
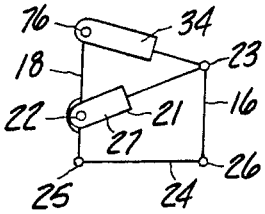

The embodiment of FIG. 11 has the fluid motor 27 positioned in the link 21 and its cylinder connected to the pivot pin 22 and its piston rod connected to the pivot pin 23. In this embodiment, the fluid motor 34 is positioned above the linkage system and has its cylinder assembly connected to the transom bracket 18 at the pivot point 76 which lies above the pivot points 22 and 25. The piston rod of this fluid motor is connected to the pivot point 23.

Figure 12:
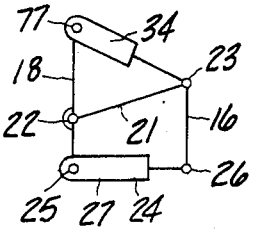

In the embodiment of FIG. 12, the fluid motor 27 is positioned in the link 24 and has its fluid cylinder housing connected to the pivot pin 25 and its piston rod connected to the pivot pin 26. The fluid motor 34 has its cylinder housing connected to the transom bracket 18 by a pivot pin 77 that is positioned above the pivot pins 22 and 25. The piston rod of this fluid motor 34 is connected to the pivot pin 23.

Figure 13:
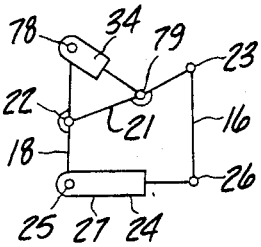

FIG. 13 shows an embodiment similar to the embodiment of FIG. 12 in the positioning of the fluid motor 27. In this embodiment, the fluid motor 34 also has its cylinder housing connected to the stern bracket 18 at a pivot point 78 that is disposed above the pivot points 22 and 25. However, the piston rod of this fluid motor is connected to the link 21 between its ends by the pivot pin 79.

Figure 14:
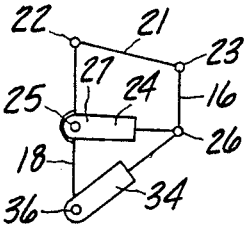

The embodiment of FIG. 14 is similar to the embodiments of FIGS. 1 and 2, however, the fluid motor 27 is reversed in the link 24 so that its cylinder assembly is connected to the pivot pin 25 and its piston rod is connected to the pivot pin 26.

Figure 15:
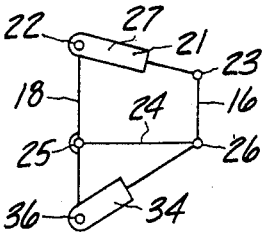

In the embodiment of FIG. 15, the fluid motor 27 is positioned in the link 21 with its cylinder housing connected to the pivot pin and its piston rod connected to the pivot pin 23. The fluid motor 34 is disposed in the orientation as in FIGS. 1 and 2 wherein the cylinder housing is connected to the stern bracket 18 at the pivot pin 36 and the piston rod is connected to the linkage at the pivot pin 26.

Figure 16:
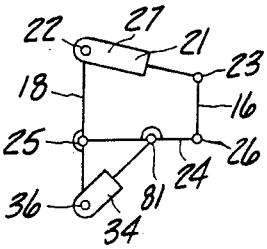

The embodiment of FIG. 16 is similar to the embodiment of FIG. 15, however, in this embodiment, the piston rod of the fluid motor 34 is connected to the link 24 intermediate the pivot pins 25 and 26 at a pivot pin 81.

In many of the arrangements shown in FIGS. 3–16, the fluid motors 27 and 34 are oriented differently than as shown in FIGS. 1 and 2 and as has been noted, these differences in orientation may require changes in the hydraulic circuitry. It is believed that those changes can readily be made by those skilled in the art based upon the described embodiment.

A number of linkage systems are obviously disclosed and various arrangements of the fluid motors and their interrelationships have been described. In addition to these several embodiments, numerous other changes and modifications may be made, without departing from the spirit and scope of the invention, as defined by the appended claims.

We claim:

1. A supporting arrangement for suspending a marine outboard drive from the transom of an associated watercraft for movement from a tilted down running condition to a tilted up out of the water condition comprising a first inextensible link adapted to be pivotally connected at one of its ends to the associated transom at a first pivot axis fixed relative to said transom. means pivotally connecting the other end of said first link to said outboard drive at a second pivot axis fixed relative to said outboard drive, a second link adapted to be pivotally connected at one of its ends to the associated transom at a third pivot axis fixed relative to said transom, means for pivotally connecting the other end of said second link to said outboar drive at a fourth pivot axis, fixed relative to said outboard drive, said first and said third pivot axes being fixed relative to each other, said second and said fourth pivot axes being fixed relative to each other, and all of said pivot axes being offset and parallel to each other, and means for changing the effective length of said second link to accommodate movement of said outboard drive relative to the transom of the associated watercraft from its tilted down position toward it tilted up position.

2. A supporting arrangement as set forth in claim 1 wherein the means for changing the effective length of the second link comprises a hydraulic device.

3. A supporting arrangement as set forth in claim 2 wherein the hydraulic device comprises a hydraulic motor.

4. A supporting arrangement as set forth in claim 3 further including shock absorbing means in said hydraulic motor for permitting the outboard drive to pop up in response to the striking of an underwater obstacle.

5. A supporting arrangement as set forth in claim 2 wherein the hydraulic device includes a hydraulic shock absorber permitting the outboard drive to pop up when an underwater obstacle is struck with sufficient force.

6. A supporting arrangement for suspending a marine outboard drive from the transom of an associated watercraft for movement from a tilted down running condition to a tilted up out of the water condition comprising a first link adapted to be pivotally connected at one of its ends to the associated transom at a first pivot axis, means pivotally connecting the other end of said first link to said outboard drive at a second pivot axis, a second link adapted to be pivotally connected at one of its ends to the associated transom at a third pivot axis, means for pivotally connecting the other end of said link to said outboard drive at a fourth pivot axis, means for changing the effective length of said second link to accommodate movement of said outboard drive relative to the transom of the associated watercraft from its tilted down position toward its tilted up position, and a fluid motor operatively connected between the transom and said outboard drive for effecting movement of said outboard drive through pivotal movement of the linkage system.

7. A supporting arrangement as set forth in claim 6 wherein the means for changing the effective length of the second link comprises a hydraulic device.

8. A supporting arrangement as set forth in claim 7 wherein the hydraulic device comprises a second fluid motor.

9. A supporting arrangement as set forth in claim 8 further including shock absorbing means in said second fluid motor for permitting the outboard drive to pop up in response to the striking of an underwater obstacle with sufficient force.

10. A supporting arrangement as set forth in claim 7 wherein the hydraulic device includes a hydraulic shock absorber permitting the outboard drive to pop up when an underwater obstacle is struck with sufficient force.

11. A supporting arrangement as set forth in claim 6 wherein the means for changing the effective length of the second link comprises a second fluid motor.

12. A supporting arrangement as set forth in claim 11 further including means for operating the fluid motors in sequence whereby one of the fluid motors is operated through its complete stroke prior to operation of the other of the fluid motors.

13. A supporting arrangement as set forth in claim 12 wherein the first acting fluid motor further includes hydraulic shock absorbing means for permitting the outboard drive to pop up when an underwater obstacle is struck with sufficient force.

14. A supporting arrangement as set forth in claim 11 wherein the first mentioned fluid motor is adapted to be pivotally connected at one of its ends to the associated transom and pivotally connected at its other of its ends to one of the links.

15. A supporting arrangement as set forth in claim 14 wherein one of the pivotal connections of the first mentioned fluid motor to the associated transom is spaced from the first and third pivot points.

16. A supporting arrangement as set forth in claim 14 wherein the pivotal connection between one of the ends of the first mentioned fluid motor and the associated transom is coincident with one of the first and third pivot points.

17. A supporting arrangement as set forth in claim 14 wherein the pivotal connection between the other end of the first mentioned fluid motor and one of the links is common with one of the second and fourth pivotal connections.

18. A supporting arrangement as set forth in claim 14 wherein the pivotal connection between the other of the ends of the first mentioned fluid motor and one of the links is between the ends of the one link.

19. A supporting arrangement as set forth in claim 17 wherein one of ther pivotal connections of the first mentioned fluid motor to the associated transom is spaced from the first and third pivot points.

20. A supporting arrangement as set forth in claim 17 wherein the pivotal connection between one of the ends of the first mentioned fluid motor and the associated transom is coincident with one of the first and third pivot points.

21. A supporting arrangement as set forth in claim 18 wherein one of the pivotal connections of the first mentioned fluid motor to the associated transom is spaced from the first and third pivot points.

22. A supporting arrangement as set forth in claim 18 wherein the pivotal connection between one of the ends of the first mentioned fluid motor and the associated transom is coincident with one of the first and third pivot points.

23. A supporting arrangement as set forth in claim 1 wherein the outboard drive is supported from the transom solely through the first and third pivot axes.

24. A supporting arrangement as set forth in claim 1 wherein the path of movement of the outboard drive relative to the transom from its tilted down position toward its tilted up position is determined solely by the first and second links.

25. A supporting arrangement for suspending a marine outboard drive from the transom of an associated watercraft for movement from a tilted down running condition to a tilted up out of the water condition comprising a first link adapted to be pivotally connected at one of its ends to the associated transom at a first, fixed pivot axis, means pivotally connecting the other end of said first link to said outboard drive at a second, fixed pivot axis, lifting means for effecting pivotal movement of said first link about its first pivot axis for moving said outboard drive vertically relative to the associated transom, a second link adapted to be pivotally connected at one of its ends to the associated transom at a third, fixed pivot axis, means for pivotally connecting the other end of said second link to said outboard drive at a fourth, fixed pivot axis, said second link being pivoted about said third axis upon operation of said lifting means, and means for changing the effective length of said second link to accommodate movement of said outboard drive relative to the transom of the associated watercraft from its tilted position toward its tilted up position without operation of said lifting means.

26. A supporting arrangement as set forth in claim 25 wherein the means for changing the effective length of the second link comprises a hydraulic device.

27. A supporting arrangement as set forth in claim 26 wherein the hydraulic device comprises a hydraulic motor.

28. A supporting arrangement as set forth in claim 27 further including shock absorbing means in said hydraulic motor for permitting the outboard drive to pop up in response to the striking of an underwater obstacle.

29. A supporting arrangement as set forth in claim 26 wherein the hydraulic device includes a hydraulic shock absorber permitting the outboard drive to pop up when an underwater obstacle is struck with sufficient force.

30. A supporting arrangement as set forth in claim 25 wherein the lift means comprises a fluid motor operatively connected between the transom and the outboard drive for effecting movement of the outboard drive through pivotal movement of the linkage system.

31. A supporting arrangement as set forth in claim 30 wherein the means for changing the effective length of the second link comprises the hydraulic device.

32. A supporting arrangement as set forth in claim 31 wherein the hydraulic device comprises a second fluid motor.

33. A supporting arrangement as set forth in claim 32 further including shock absorbing means in said second fluid motor for permitting the outboard drive to pop up in response to the striking of an underwater obstacle with sufficient force.

34. A supporting arrangement as set forth in claim 31 wherein the hydraulic device includes a hydraulic shock absorber permitting the outboard drive to pop up when an underwater obstacle is struck with sufficient force.

35. A supporting arrangement as set forth in claim 30 wherein the means for changing the effective length of the second link comprises a second fluid motor.

36. A supporting arrangement as set forth in claim 35 further including means for operating the fluid motors in sequence whereby one of the fluid motors is operated through its complete stroke prior to operation of the other of the fluid motors.

37. A supporting arrangement as set forth in claim 36 wherein the first acting fluid motor further includes hydraulic shock absorbing means for permitting the outboard drive to pop up when an underwater obstacle is struck with sufficient force.

38. A supporting arrangement as set forth in claim 35 wherein the first mentioned fluid motor is adapted to be pivotally connected at one of its ends to the associated transom and pivotally connected at its other of its ends to one of the links.

39. A supporting arrangement as set forth in claim 38 wherein one of the pivotal connections of the first mentioned fluid motor to the associated transom is spaced from the first and third pivot points.

40. A suporting arrangement as set forth in claim 38 wherein the pivotal connection between one of the ends of the first mentioned fluid motor and the associated transom is coincident with one of the first and third pivot points.

41. A supporting arrangement as set forth in claim 38 wherein the pivotal connection between the other end of the first mentioned fluid motor and one of the links is common with one of the second and fourth pivotal connections.

42. A supporting arrangement as set forth in claim 38 wherein the pivotal connection between the other of the ends of the first mentioned fluid motor and one of the links is between the ends of the one link.

43. A supporting arrangement as set forth in claim 41 wherein one of the pivotal connections of the first mentioned fluid motor to the associated transom is spaced from the first and third pivot points.

44. A supporting arrangement as set forth in claim 41 wherein the pivotal connection between one of the ends of the first mentioned fluid motor and the associated transom is coincident with one of the first and third pivot points.

45. A supporting arrangement as set forth in claim 42 wherein one of the pivotal connections of the first mentioned fluid motor to the associated transom is spaced from the first and third pivot points.

46. A supporting arrangement as set forth in claim 42 wherein the pivotal connection between one of the ends of the first mentioned fluid motor and the associated transom is coincident with one of the first and third pivot points.

* * * * *